US012108823B1

(12) United States Patent
Milder

(10) Patent No.: US 12,108,823 B1
(45) Date of Patent: Oct. 8, 2024

(54) EAR MUFFS FOR HATS

(71) Applicant: Larry Milder, Escoheag, RI (US)

(72) Inventor: Larry Milder, Escoheag, RI (US)

( * ) Notice: Subject to any disclaimer, the term of this patent is extended or adjusted under 35 U.S.C. 154(b) by 0 days.

(21) Appl. No.: 18/609,946

(22) Filed: Mar. 19, 2024

(51) Int. Cl.
*A41B 1/00* (2006.01)
*A42B 1/0188* (2021.01)

(52) U.S. Cl.
CPC ..... *A42B 1/0188* (2021.01)

(58) Field of Classification Search
CPC ..... A42B 1/0188; A42B 7/00; A42B 3/16
See application file for complete search history.

(56) References Cited

U.S. PATENT DOCUMENTS 280,005 A * 6/1883 Beard et al. ..... A42B 1/0188 2/172
782,769 A * 2/1905 Wallach ..... A42B 1/0186 2/172
849,102 A 4/1907 Borneman
1,438,171 A * 12/1922 Delson ..... A42B 1/0188 2/172
2,111,147 A * 3/1938 Jonas ..... A61F 11/06 2/209
2,149,121 A * 2/1939 Kronenberger ..... A42B 1/0188 2/209
2,184,996 A * 12/1939 Jacobs ..... A61F 11/06 2/209
2,333,392 A * 11/1943 Rosenzweig ..... A42B 1/0188 2/209
2,439,289 A * 4/1948 Fanslow ..... A61F 11/06 2/209
2,442,825 A * 6/1948 Rabushka ..... A42B 1/0188 2/209
2,561,857 A * 7/1951 Goldman ..... A42B 1/0188 D29/112
2,572,746 A * 10/1951 Mougel ..... A42B 1/0188 D29/112
2,582,907 A * 1/1952 Kaufmann ..... A61F 11/06 D29/112
2,597,508 A * 5/1952 Majewski ..... A61F 11/06 2/209
2,671,221 A * 3/1954 Karrol ..... A61F 11/06 2/208
2,704,367 A * 3/1955 Gellman ..... A42B 1/0188 2/195.5
3,249,949 A * 5/1966 Rosenberg ..... A61F 11/06 D29/112
3,354,471 A * 11/1967 Longo ..... A61F 11/06 2/209
4,850,055 A * 7/1989 Hwang ..... A61F 11/06 2/209
5,426,790 A * 6/1995 Robertson ..... A42B 1/248 2/209

(Continued)

*Primary Examiner* — Richale L Quinn
(74) *Attorney, Agent, or Firm* — Sanchelima & Associates, P.A.; Christian Sanchelima; Jesus Sanchelima

(57) ABSTRACT

An earmuff for hats, including a holder assembly and a cover assembly. The holder assembly includes a first ring and a second ring coupled together from a bottom portion thereof defining a separated top portion. The cover assembly encloses the holder assembly. The cover assembly is attached to a hat through the holder assembly. The holder assembly is operated to open and close to be clipped to the hat. The cover assembly, when attached to the hat, is an earmuff.

7 Claims, 2 Drawing Sheets

(56) References Cited

U.S. PATENT DOCUMENTS 5,477,629 A * 12/1995 Gleason, Jr. ..... A42B 1/0184 40/329
6,038,329 A * 3/2000 Lee ..... H04R 1/1058 379/430
6,357,642 B1 * 3/2002 Marchessault ..... A45F 5/02 2/209.13
6,580,800 B1 * 6/2003 Yamasaki ..... H04R 1/105 381/381
7,424,125 B2 * 9/2008 Amae ..... H04R 5/0335 381/370
D594,601 S * 6/2009 Briggs ..... D29/112
8,060,950 B1 * 11/2011 Thornton ..... A42B 1/0188 2/209
9,066,829 B2 * 6/2015 Le Gette ..... A61F 11/14
9,854,348 B2 * 12/2017 Naylor-Warren .... H04R 1/1066
10,016,305 B2 * 7/2018 Currier ..... A61F 11/14
D886,802 S * 6/2020 Willis ..... D29/112
2004/0005071 A1 * 1/2004 Siskin ..... H04R 5/0335 381/374
2005/0028250 A1 * 2/2005 Zaic ..... A42B 3/16 2/209
2006/0053530 A1 * 3/2006 Yount ..... A42B 1/0188 2/209
2012/0047628 A1 * 3/2012 Hardy ..... A42B 1/0188 2/172
2012/0159695 A1 * 6/2012 Hardy ..... A42B 1/0188 2/410
2013/0133671 A1 * 5/2013 Fairclough ..... A61F 11/14 2/209
2015/0216731 A1 * 8/2015 Bouza ..... A61F 11/14 2/209
2016/0067101 A1 * 3/2016 Currier ..... A61F 11/14 2/209
2017/0027250 A1 * 2/2017 Paquette ..... A42B 1/0188
2019/0059492 A1 * 2/2019 Grammer ..... A42B 1/0188
2019/0306612 A1 * 10/2019 Washburn ..... H04R 1/1058
2021/0307448 A1 * 10/2021 Sanders ..... A42B 3/225
2021/0330014 A1 * 10/2021 Kim ..... A42B 1/008
2022/0130362 A1 * 4/2022 Washburn ..... G10K 11/168
2023/0284726 A1 * 9/2023 Leng ..... A42B 1/0188

* cited by examiner

EAR MUFFS FOR HATS

BACKGROUND OF THE INVENTION

1. Field of the Invention

The present invention relates to an earmuff for hats and, more particularly, to an earmuff for hats that allows having earmuffs on a hat and removing them as needed.

2. Description of the Related Art

Several designs for earmuffs have been designed in the past. None of them, however, include an attachment member to attach the earmuff to an edge of the hat.

Applicant believes that a related reference corresponds to U.S. Pat. No. 2,671,221 issued for an earmuff, comprising a pair of flexible normally semi-circular spring frames hingedly connected to each other. Applicant believes that another related reference corresponds to U.S. Pat. No. 849,102 issued for an earmuff attachment for hats. None of these references, however, teach of an ear protection device comprising a set of thin earmuffs for use with hats having a collapsible or folding frame.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an earmuff for hats that includes an elastic attaching member so that it can be adjusted by clipping on a hat.

It is another object of this invention to provide an earmuff for hats that includes protective members made of a soft material.

It is still another object of the present invention to provide an earmuff for hats that is easy to carry when taken to a retracted configuration.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
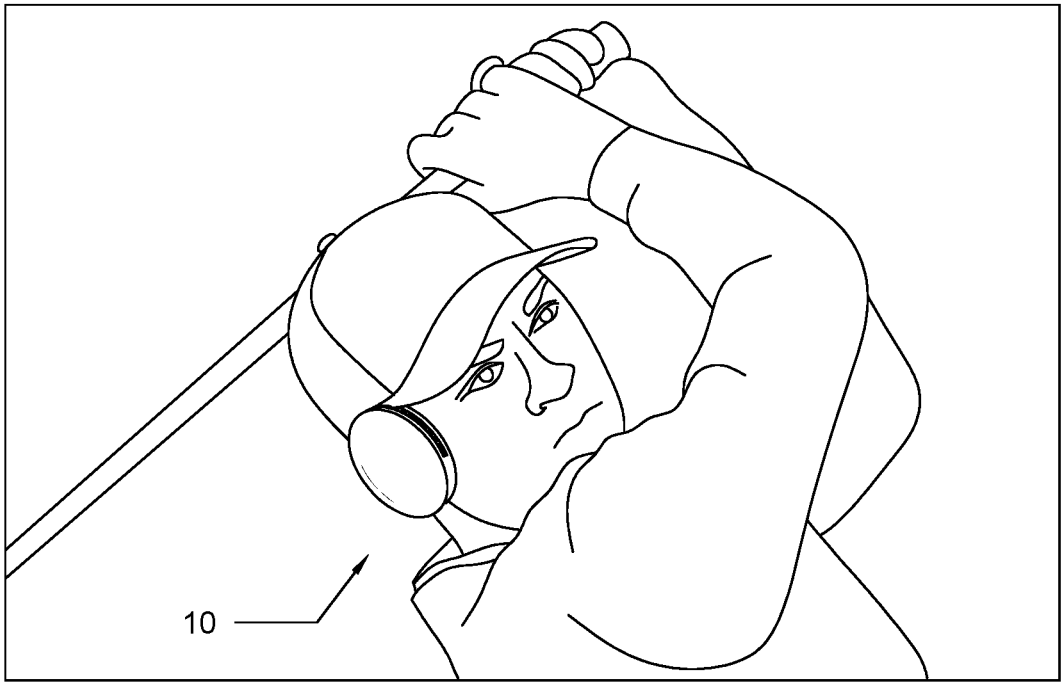
FIG. 1 represents an isometric operational view of the present invention 10.

Referring now to the drawings, where the present invention is generally referred to with numeral 10, it can be observed that it basically includes a holder assembly 20 and a cover assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 4:
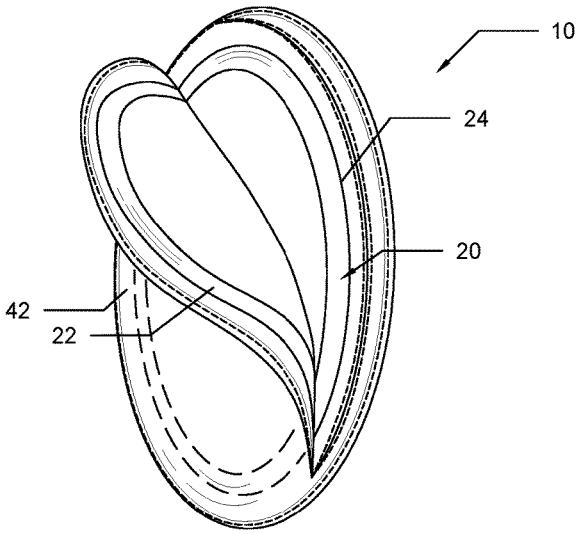
FIG. 4 is a representation of a see through view of the present invention 10. The present invention 10 includes a holder assembly 20 and a cover assembly 40.

As best illustrated in FIG. 4 the holder assembly 20 may include a first ring 22 and a second ring 24. The first ring 22 may have a ring shape. It also may be suitable for the first ring 22 to have a rectangular-frame shape, a triangular-frame shape, or any other suitable shape. The second ring 24 may be a mirror image of the first ring. The first ring 22 and the second ring 24 may be an annealed wire. It also may be suitable for the first ring 22 and the second ring 24 to be galvanized wire, or any other wire presenting flexibility and resistance. The first ring 22 and the second ring 24 may be a cylindrical metallic element in a closed loop. It also may be suitable for the first ring 22 and the second ring 24 to be a rectangular or triangular metallic element in a closed loop.

The first ring 22 may include a first bottom portion and a first top portion. The second ring 24 may include a second bottom portion and a second top portion. The first bottom portion of the first ring 22 may be coupled to the second bottom portion of the second ring 24. In a preferred embodiment the first bottom portion and the second bottom portion are welded together. The first bottom portion of the first ring 22 extends from a central portion of the first ring 22 to a bottommost end thereof. The second bottom portion of the second ring 24 extends from a central bottom portion to a second ring bottommost end. The second ring 24 may be perpendicular to the first ring 22. The first top portion and the second top portion may be separated in an open configuration and in abutting contact in a closed configuration.

The cover assembly 40 may include a cover 42 defined by a left portion and a right portion sewn together by means of sewings 44. In a preferred embodiment the cover 42 may be made of wool and cotton. It also may be suitable for the cover 42 to be made of fleece, or any other fabric. In an alternate embodiment the cover 42 is made of a rigid material such as aluminum, polyurethane and so on to protect ears from hits. It also may be suitable for the cover 42 to include means for noise reduction. In a preferred embodiment the cover 42 is placed over the user's ear.

The cover assembly 40 may enclose the holder assembly 20 therein. In a preferred embodiment the first ring 22 may be attached to an interior wall of the left portion of cover 42 and the second ring 24 may be attached to an interior wall of the right portion of cover 42. The left portion and the right portion may be sewn together. It also may be suitable for the left portion and the right portion to be built in a single piece.

In one embodiment the cover 42 is removable attached to the holder assembly 20 to allow wearing variations of the cover 42. It also may be suitable to use the holder assembly 20 to be used separately to secure a hat to the user In a preferred embodiment the first ring 22 and the second ring 24 may have a fabric coating.

Figure 2:
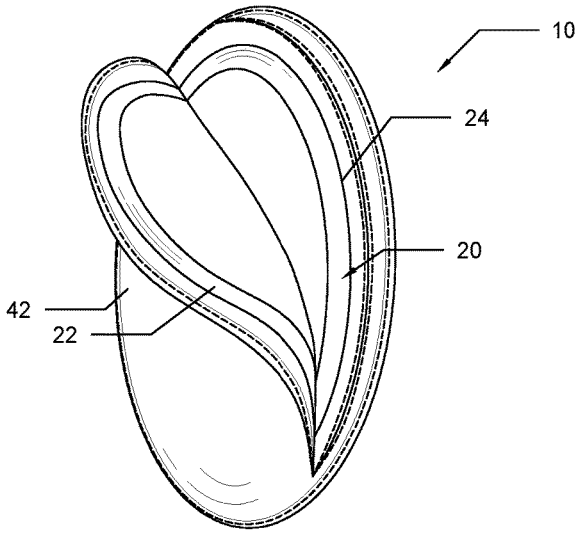
FIG. 2 shows an isometric view of the present invention 10 in an open configuration.
Figure 3:
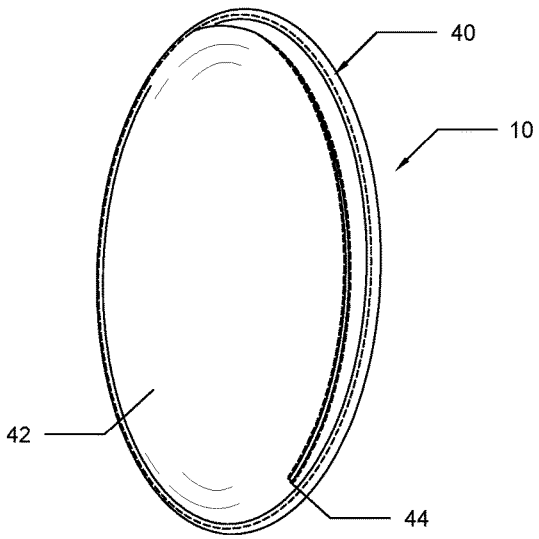
FIG. 3 illustrates an isometric view of the present invention 10 in a closed configuration.

The cover 42 may be hollow. The cover 42 may include an open portion and a closed portion. The open portion of the cover 42 may extend a circumference of the cover 42. The open portion of the cover 42 may extend from a central portion of the cover to an uppermost end thereof. The first top portion of the first ring 22 and the second top portion of the second ring 24 may be manipulated to have the cover 42 in an open configuration as illustrated in FIG. 2 or in a closed configuration illustrated in FIG. 3. The present invention 10 may be taken to a closed configuration having the first top portion of the first ring 22 and the second top portion of the second ring 24 enclosing a portion of a wall of the hat. The present invention 10 may be removed from the hat by taking the present invention 10 to an open configuration. The present invention 10 may be carried out in a closed configuration. The present invention 10 may further be used to store any object therein.

As best illustrated in FIG. 1 the present invention 10 is to be attached to the hat by clicking the first top portion of the first ring 22 and the second top portion of the second ring 24 on one of the walls of the hat. It may be suitable for the second ring 34 and the first ring 22 to include a magnet to securely clipping the present invention to the hat.

Figure 5:
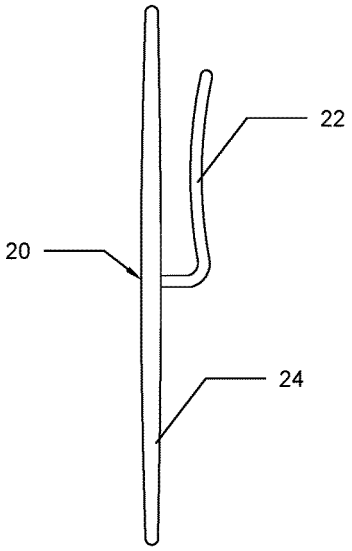
FIG. 5 is a side view of an alternative embodiment for the holder assembly 20.

Referring now to FIG. 5 it can be observed that the first ring 22 may extend from a middle portion of the second ring 24. In the alternative embodiment shown in FIG. 5 the first ring has a semi ring shape and extends parallel to the second ring 24 by means of rod members connecting the first ring 22 and the second ring 24.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An earmuff for hats, comprising:

a holder assembly, wherein said holder assembly includes a first ring and a second ring coupled together, wherein said first ring and said second ring are configured to be partially separated therebetween defining an open configuration; and a cover assembly, wherein said cover assembly encloses said holder assembly having an open portion, wherein said cover assembly is attached to a hat by means of said holder assembly, wherein said cover assembly includes a left portion and a right portion, wherein said left portion and said right portion have a circular shape, said left portion and said right portion are partially sewn together covering a junction portion of said first ring and said second ring, wherein said first ring and said second ring are annealed wire or galvanized wire in a closed loop, wherein cover assembly is made of a fabric material, wherein said first ring has an equal diameter than a diameter of said second ring, said first ring is a mirror image of said second ring, said first ring and said second ring have a circular shape.

2. The earmuff for hats set forth in claim 1, wherein said first ring includes a first bottom portion and a first top portion, said second ring includes a second bottom portion and a second top portion, wherein said first bottom portion and said second bottom portion are welded together.

3. The earmuff for hats set forth in claim 2, wherein said first top portion and said second top portion are separated in said open configuration, said second top portion and said first top portion are in abutting contact therebetween is said closed configuration, wherein said second top portion and said first top portion clip to a wall of said hat.

4. The earmuff for hats set forth in claim 1, wherein said first ring extends a circumference of an interior wall of said left portion.

5. The earmuff for hats set forth in claim 1, wherein said second ring extends a circumference of an interior wall of said right portion.

6. The earmuff for hats set forth in claim 1, wherein said covers are made of wool and cotton.

7. An earmuff for hats, consisting of:

a holder assembly, wherein said holder assembly includes a first ring and a second ring, wherein said first ring includes a first bottom portion and a first top portion, said second ring includes a second bottom portion and a second top portion, wherein said first bottom portion and said top portion are welded together, wherein said first top portion and said second top portion are operated to be separated defining an open configuration, said second top portion and said first top portion are operated to be in abutting contact therebetween is a closed configuration, wherein said second top portion and said first top portion clip to a wall of a hat, wherein said first ring and said second ring are annealed wire or galvanized wire in a closed loop, wherein said first ring has and equal diameter than a diameter of said second ring, said first ring is a mirror image of said second ring; and a cover assembly, wherein said cover assembly encloses said holder assembly, wherein said cover assembly is attached to said hat by means of said holder assembly, wherein said cover assembly is removable attached from said holder assembly, wherein said cover assembly is formed by a left portion and a right portion, wherein said left portion and said right portion have a circular shape, said left portion and said right portion are partially sewn together covering an junction portion of said first ring and said second ring defining a top open portion, wherein said first ring extends a circumference of an interior wall of said left portion, wherein said second ring extends a circumference of an interior wall of said right portion.

* * * * *